US009053630B2

(12) United States Patent
Clark et al.

(10) Patent No.: US 9,053,630 B2
(45) Date of Patent: Jun. 9, 2015

(54) METHODS AND SYSTEMS FOR DEPICTING A DATA DRIVEN MINIMUM SAFE ALTITUDE

(75) Inventors: Jason W. Clark, Evergreen, CO (US); Thorsten Wiesemann, Hofheim am Tanus (DE); Cindy Dorfmann, Darmstadt (DE)

(73) Assignee: The Boeing Company, Chicago, IL (US)

( * ) Notice: Subject to any disclaimer, the term of this patent is extended or adjusted under 35 U.S.C. 154(b) by 498 days.

(21) Appl. No.: 12/706,852

(22) Filed: Feb. 17, 2010

(65) Prior Publication Data

US 2011/0199237 A1 Aug. 18, 2011

(51) Int. Cl.
*G08B 23/00* (2006.01)
*G08G 5/00* (2006.01)

(52) U.S. Cl.
CPC ..... *G08G 5/0021* (2013.01); *G08G 5/0086* (2013.01)

(58) Field of Classification Search
CPC ..... G01C 21/00; G01C 23/00; G08B 23/00; G06T 11/60; G01S 13/18
USPC ..... 340/970, 973; 701/211, 4, 9, 8; 345/619; 342/94
See application file for complete search history.

(56) References Cited

U.S. PATENT DOCUMENTS

| | | | | |
|---|---|---|---|---|
| 5,638,282 | A | 6/1997 | Chazelle et al. | |
| 6,173,220 | B1 * | 1/2001 | Schmitt | 701/4 |
| 6,289,277 | B1 | 9/2001 | Feyereisen et al. | |
| 6,653,947 | B2 | 11/2003 | Dwyer et al. | |
| 6,731,234 | B1 * | 5/2004 | Hager et al. | 342/94 |
| 6,985,091 | B2 | 1/2006 | Price | |
| 8,032,268 | B2 * | 10/2011 | Burgin et al. | 701/8 |
| 2002/0143439 | A1 | 10/2002 | Morizet et al. | |
| 2004/0160341 | A1 * | 8/2004 | Feyereisen et al. | 340/970 |
| 2005/0200502 | A1 * | 9/2005 | Reusser et al. | 340/973 |
| 2007/0174005 | A1 * | 7/2007 | Bitar et al. | 701/211 |
| 2009/0189787 | A1 * | 7/2009 | Khatwa | 340/970 |
| 2009/0326741 | A1 * | 12/2009 | Marty et al. | 701/4 |
| 2010/0082186 | A1 * | 4/2010 | Burgin et al. | 701/9 |
| 2010/0265268 | A1 * | 10/2010 | Wilson et al. | 345/619 |

FOREIGN PATENT DOCUMENTS

| | | | |
|---|---|---|---|
| EP | 2204639 | A1 | 7/2010 |
| WO | 0031564 | A1 | 6/2000 |
| WO | 03071371 | A1 | 8/2003 |

OTHER PUBLICATIONS

Combined Search and Examination Report of GB1105124.0; Jul. 15, 2011; 7 pages.
Pschierer, C. et al; Human Factors Evaluation of a Dynamic Channel Depiction of Navigation Procedures in SVS Displays; Enhanced and Synthetic Vision; Proceedings vol. 6559; Apr. 27, 2007;13 pages.
U.S. Appl. No. 12/751,144, filed Mar. 31, 2010.
Partial European Search Report of EP11154880.6-2215 dated Jul. 4, 2011; 6 pages.

* cited by examiner

*Primary Examiner* — Steven Lim
*Assistant Examiner* — Kaleria Knox
(74) *Attorney, Agent, or Firm* — Armstrong Teasdale LLP

(57) ABSTRACT

A method for providing a minimum safe altitude indication on an aircraft display is described. The method includes utilizing current aircraft heading and position data to generate a location and orientation for an own-ship depiction with respect to an aircraft display, utilizing the current position data, along with terrain data, to generate minimum safe altitude data for an area surrounding the aircraft, and displaying on the aircraft display, about the location for own-ship depiction, the minimum safe altitudes surrounding the aircraft.

18 Claims, 4 Drawing Sheets

METHODS AND SYSTEMS FOR DEPICTING A DATA DRIVEN MINIMUM SAFE ALTITUDE

BACKGROUND

The field of the disclosure relates generally to pilot situational awareness, and more specifically, to methods and systems for depicting a data driven minimum safe altitude.

Current minimum safe altitude (MSA) depictions are pre-composed, which in this case means such MSAs are only referenced to one point on the airport surface and are always depicted in a north up orientation. As a result, in order for a pilot to interpret the MSA information in an emergency situation, the pilot must first do mental translations so that they can orient themselves in relation to the "fixed" MSA and then project where the high terrain features exist in relation to their aircraft. Summarizing, current MSAs are depicted on paper or in a pre-composed electronic chart and do not consider current context of the aircraft.

A traffic alert and collision avoidance system (TCAS) is an aircraft collision avoidance system designed to reduce the incidence of mid-air collisions. TCAS is also configured to help an aircraft to avoid terrain but is primarily intended as a warning system. MSA depictions are meant to give a quick overview of the surrounding terrain and/or obstacles in the immediate area.

Current MSA's are depicted on paper or in a pre-composed electronic chart and do not consider current context of the aircraft.

BRIEF DESCRIPTION

In one aspect, a method for providing a minimum safe altitude indication on an aircraft display is provided. The method includes utilizing current aircraft heading and position data to generate a location and orientation for an own-ship depiction with respect to an aircraft display, utilizing the current position data, along with terrain data, to generate minimum safe altitude data for an area surrounding the aircraft and displaying on the aircraft display, about the location for own-ship depiction, the minimum safe altitudes surrounding the aircraft.

In another aspect, a minimum safe altitude display system is provided that includes a processing device, a display communicatively coupled to the processing device, and an interface communicatively coupled to the processing device. The interface is operable for providing current aircraft heading data, current aircraft position data, and terrain data to the processing device. The processing device is programmed to utilize the heading data and the position data to generate a location and orientation for an own-ship depiction with respect to the display, and further programmed to utilize the position data and terrain data, to generate minimum safe altitude data for an area surrounding the aircraft and cause the minimum safe altitude data to be displayed on the display about the location for own-ship depiction.

In still another aspect, a method of displaying minimum safe altitude information is provided. The method includes displaying an own-ship depiction, and displaying a minimum safe altitude depiction about the own-ship depiction, where the minimum safe altitude depiction maintains an orientation with the own-ship depiction.

The features, functions, and advantages that have been discussed can be achieved independently in various embodiments or may be combined in yet other embodiments further details of which can be seen with reference to the following description and drawings.

DETAILED DESCRIPTION

This disclosure relates generally to aircraft display configuration, and more particularly, to methods and systems for depicting a data driven minimum safe altitude. One exemplary embodiment that will be used as a familiar, but non-exclusive example throughout the disclosure, relates to flight deck display systems used in aircraft. The text will often describe fight deck display systems, however, the described system may be equally applicable to maritime and sub-mariner applications as well as extra-terrestrial navigation.

Embodiments are described herein with respect to aircraft, which include, but are not limited to, fixed wing and rotary wing aircraft operating near Earth's surface. However, such embodiments are practicable with any vehicle that is operated at a vertical displacement from some form of terrain and/or obstruction. For example, methods described herein may be used in a submarine or a submersible, for which the terrain may include a seafloor, and/or an extraplanetary vehicle, for which the terrain may include a surface of a remote body, such as the moon or a planet other than Earth. In the context of sub-sea-level travel, elevations may be expressed as negative values.

Furthermore, embodiments described herein may be used to indicate a vertical displacement of a vehicle with respect to terrain either below or above the vehicle. For example, operation of a submersible within a cave system may benefit from display of vertical displacement from both a floor and a ceiling of the surrounding terrain. For such applications, the embodiments may be modified, such as by calculating a maximum safe altitude as opposed to a minimum safe altitude.

Embodiments described herein facilitate the dynamic composition and display of a relative altitude indicator depicting a relative altitude of a vehicle in potential directions of travel. Such a relative altitude indicator may enable an operator of the vehicle to instantly determine a safe direction of travel in an emergency situation.

The embodiments may be implemented in various physical configurations based on the target platform and aircraft. The data-driven aspect of the system utilizes data elements that are grouped as procedures but accessed from individual, separate entities stored in a data-store or database. Initial EFB applications, which are primarily focused on the transition from paper to electronic displays, store procedures or charts as unique pre-composed files where particular elements exist in multiple files. In contrast to those initial EFB applications, an electronic display that includes data-driven capabilities as described herein, organizes elements based on chart or procedure definitions, but realizes and renders the display image by accessing the elements individually and applying rules or heuristics to provide the desired depiction.

Figure 1:
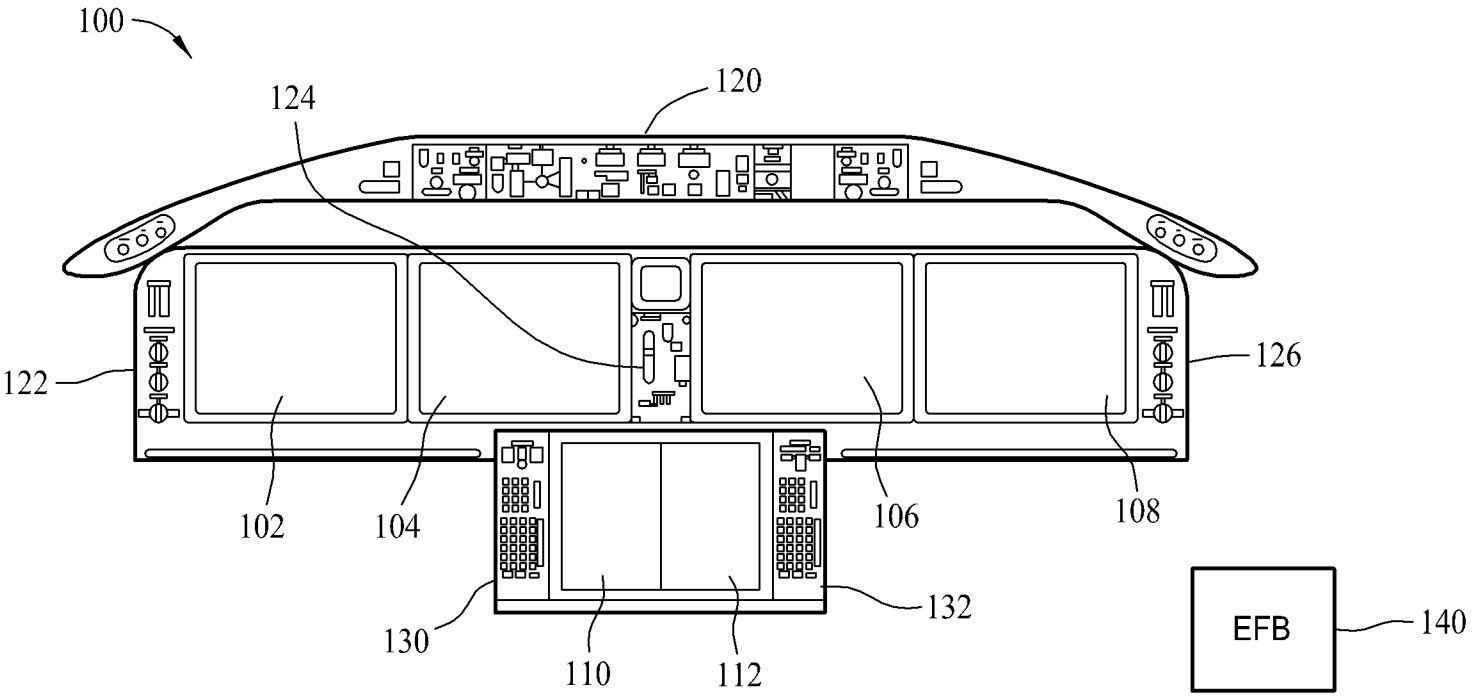
FIG. 1 is a forward perspective view of an aircraft cockpit display panel that includes at least one display screen.

Referring now to the drawings, FIG. 1 is a forward perspective view of an exemplary aircraft cockpit 100 that includes a plurality of display screens 102, 104, 106, 108, 110, and 112. As is well known, a cockpit such as cockpit 100 will include multiple instruments and interfaces including switches, indicators, dedicated displays and the like. These are shown generally in FIG. 1 as 120, 122, 124, and 126. Those skilled in the art will realize that aircraft cockpit 100 is a depiction of a two person cockpit, and that cockpits that are configured for a single user also exist and would typically include fewer components.

In the embodiment illustrated, the display screens are positioned on aircraft cockpit display panel 100. In alternative embodiments, one or more of the display screens may be positioned on an auxiliary panel, for example, the electronic flight bag display 140 which is located in the cockpit or positioned elsewhere within the aircraft. For example, and another alternative embodiment, one of the display screens may be part of a mobile device, such as an electronic flight bag, that may be viewed anywhere. During aircraft operation, the display screens are available for viewing by a pilot and/or co-pilot of the aircraft.

In the depiction, display screens 102, 104, 106, and 108 are depicted without any integrated controls and the information provided to the pilot on such screens is determined via a different user interface or through programming, for example, of a flight management system. Alternatively, display screens 110 and 112 include integrated controls 130 and 132 respectively, which allow a pilot (or copilot) to select the information that is to be displayed on display screens 110 and 112, subject to the programming associated with such "smart" displays.

Vehicle attributes described herein may include, but are not limited to, a vehicle type (e.g., a fixed wing aircraft), a vehicle capability (e.g., directions of travel, a climb capability, and/or an operating envelope), and/or a load weight. An operating envelope may include, for example, a maximum load factor for one or more directions (e.g., positive vertical acceleration and negative vertical acceleration) at one or more velocities.

Figure 2:
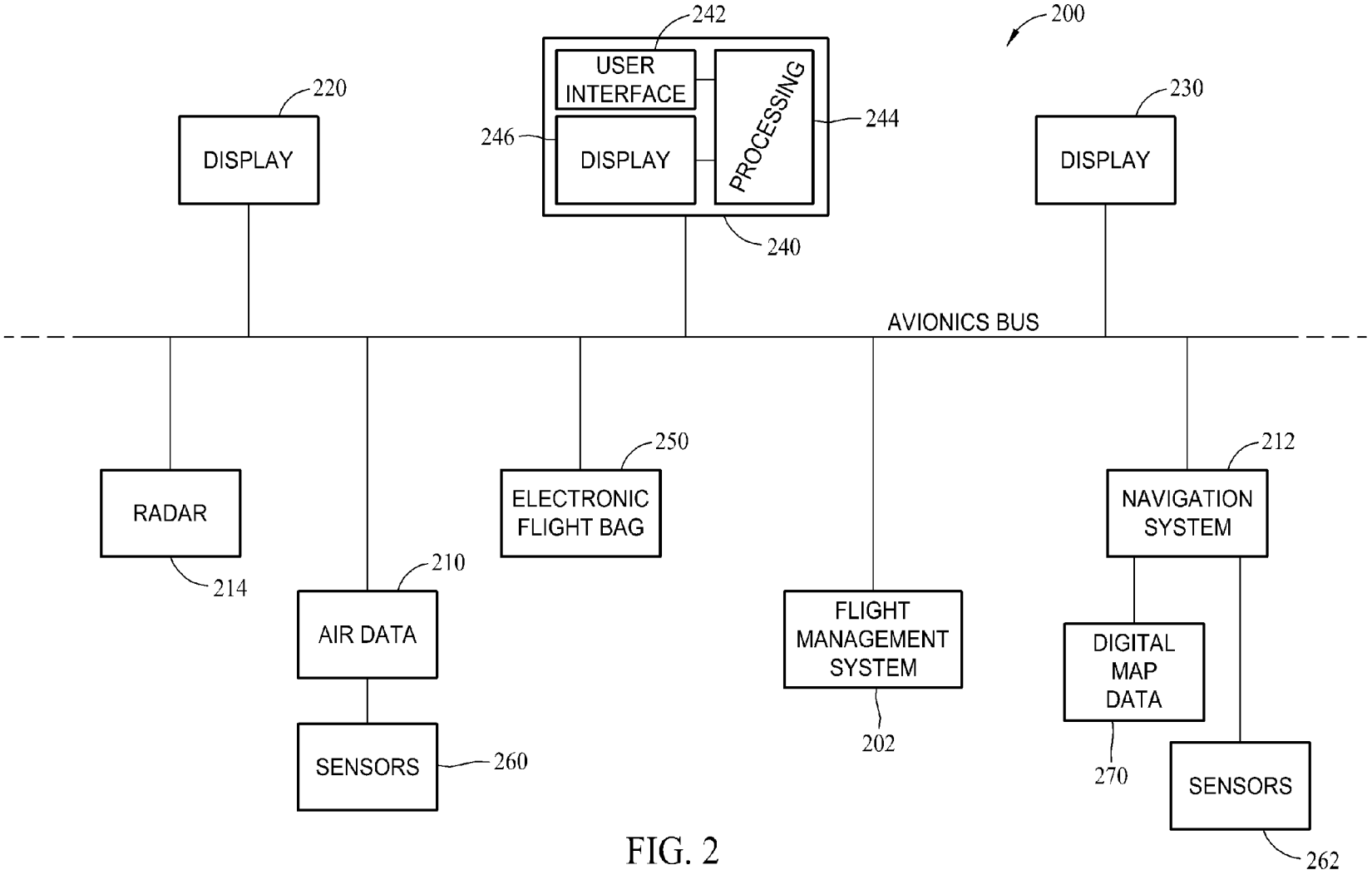
FIG. 2 is a simple block diagram of avionics systems and displays that are interconnected via an avionics bus.

FIG. 2 is a simple block diagram 200 which illustrates to a certain extent the functioning of cockpit displays. FIG. 2 depicts one embodiment and it should be understood that many other configurations are possible. Specifically, a flight management system (FMS) 202 is connected to an avionics bus 204, and the FMS 202 communicates with other systems, for example, air data system 210, navigation system 212, and radar 214 via the avionics bus 204. In the embodiment, a number of displays 220, 230, and 240 are also attached to, and communicate via, the avionics bus 203. Displays 220 and 230 are equivalent to display 102, 104, 106, and 108 in FIG. 1. Display 240 is equivalent to display 110 in FIG. 1 as it includes a user input device 242 (e.g., integrated controls 130) and an internal processing capability 244 as well as the display 246. Display 220 and 230 are sometimes referred to as a primary flight display well display 240 is sometimes referred to as a multi-function display. Certain systems in an aircraft, for example radar 214, may include a dedicated display (not shown in FIG. 2) that is interfaced to the radar system via a dedicated interface.

An electronic flight bag 250 may be connected to avionics bus 204. Sensors 260 and 262 are associated with air data system 210 navigation system 212 respectively. A database of terrain data, sometimes referred to as a digital terrain elevation map 270, may be communicatively coupled to navigation system 212 as shown, or it may be directly coupled to avionics bus 204 such that the database is accessible by systems other than navigation system 212. In any event, FIG. 2 serves to illustrates that the various displays of a cockpit, such as cockpit 100, may be utilized to illustrate various flight related data, including map data, navigation data, horizontal situation data, flight planning data, performance data, and environmental data to name but a few.

In an exemplary embodiment, digital terrain elevation map 270 is a topographical map that includes a plurality of points, each of which corresponds to a geographic position and/or geographic area. For example, each point may correspond to a geographic area approximately 100 meters square, approximately 30 meters square, or approximately 10 meters square, although other spatial resolutions are contemplated.

Figure 3:
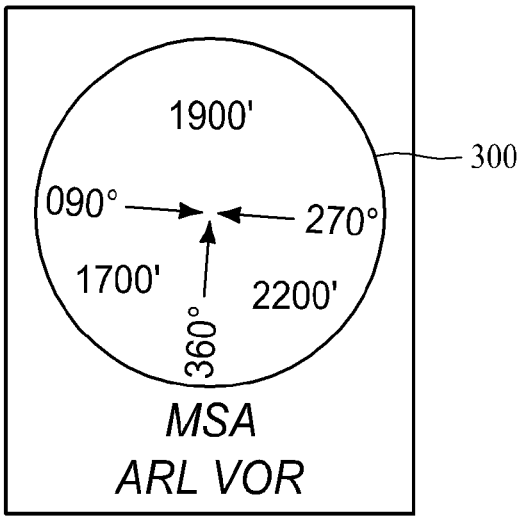
FIG. 3 is a depiction of a current minimum safe altitude (MSA) indicator.

FIG. 3 is a currently utilized terminal chart depiction of a minimum safe altitude (MSA) indicator 300. As will be noted by those skilled in the art, the MSA indicator 300 does not include an own-ship depiction and is fixed. For the particular location that is depicted in FIG. 3, the minimum safe altitude is 1700 feet from about 360 degrees to about 90 degrees, 1900 feet from about 90 degrees to about 270 degrees, and about 2200 feet from about 270 degrees to about 360 degrees. As described above, the MSA indicator 300, when embodied on a paper terminal chart, cannot provide a situational context to a pilot without the pilot first translating the north up configuration of the MSA indicator 300 to a current orientation of the aircraft. While an electronic version of MSA indicator 300 removes the paper terminal chart from the cockpit, the pilot still has to do the translation between the current orientation of the aircraft and the depiction provided by the electronic version of MSA indicator 300.

Figure 4:
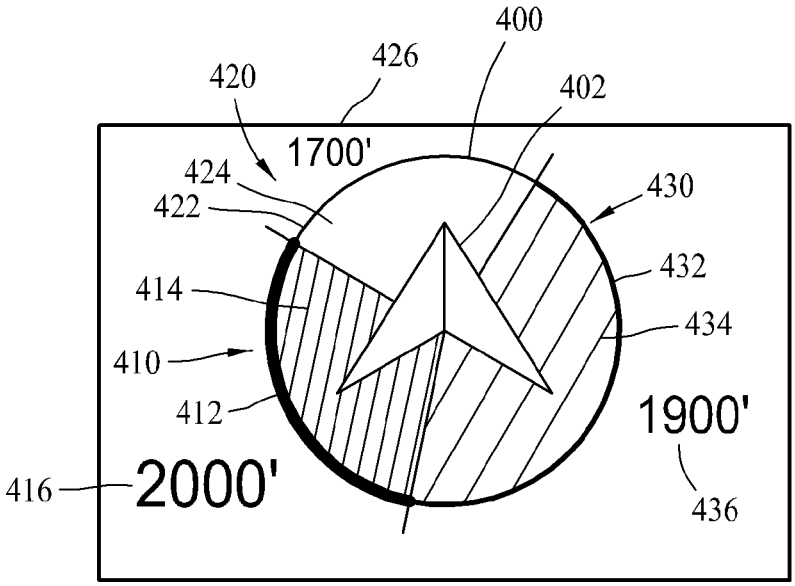
FIG. 4 is a depiction of an MSA indicator that incorporates an own-ship indicator therein.

FIG. 4 is a depiction of an MSA indicator 400 according to one embodiment, which has been added to a display that includes an own-ship depiction 402. It is to be noted that the MSA indicator 400 has "rotated" with respect to the MSA indicator 300 (shown in FIG. 3). The result is an intuitive display that is presented to the pilot, who can then easily determine the minimum safe altitudes with respect to the current orientation of his aircraft. In the embodiment of FIG. 4, the highest elevation zone 410 is marked with a thicker border 412, closely spaced shading lines 414 and a bigger font 416 whereas the lowest elevation zone 420 is marked with a thin border 422, further separated shading (or no shading) 424 and smaller font 426. It follows then that a zone 430 with an elevation between the highest elevation zone 410 and the lowest elevation zone 420 is marked with a medium border 432, shading lines 434 that are in between shading lines 414 and 424, and a font 436 whose size is in between fonts 416 and 426.

While the example depictions in FIGS. 3 and 4 are depictions that illustrate three zones, it should be noted that embodiments that include fewer than three zones and more than three zones are contemplated.

In at least one embodiment, as the vehicle associated with cockpit 100 travels, the MSA indicator 400 is redisplayed to reflect changes in the surrounding terrain and/or changes in the true altitude of the vehicle. In embodiments, the MSA indicator 400 rotates as the heading of the aircraft changes. In embodiments, the data utilized to provide such a rotation is based on data received via a navigation system 212, for example, aircraft heading information. Additionally, the MSA indicator 400 becomes useful for more than a single point (as is the case with a paper based MSA) since digital terrain elevation data, for example, from a map database, may be utilized to update the various elevations that are associated with the MSA indicator 400 during a flight. In summary, MSA indicator 400 is a real time, context based MSA which can be displayed, for example, on a moving map display during terminal procedures to enhance pilot situation awareness and further provides a data driven solution for the depiction of MSA information.

Figure 5:
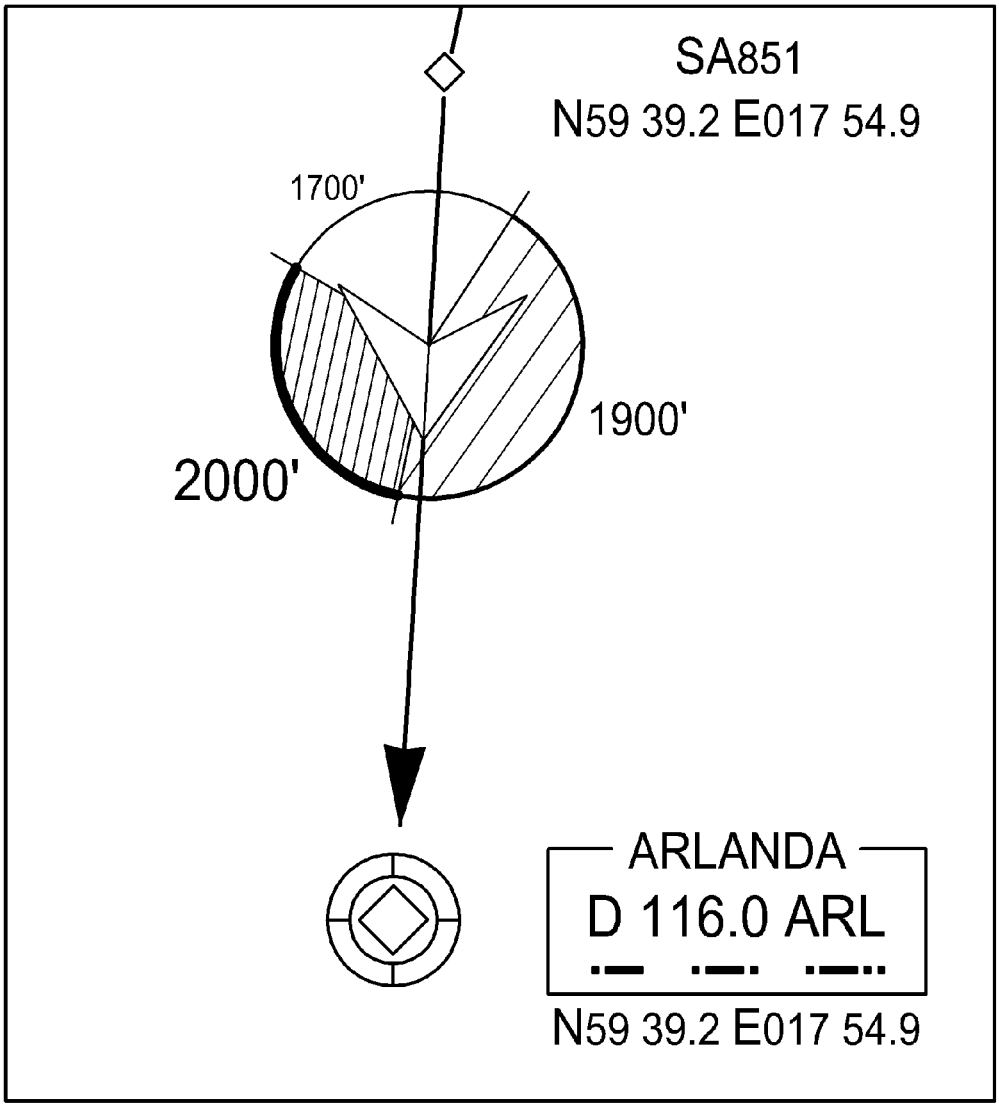
FIG. 5 is an example of the MSA indicator of FIG. 4 as it appears on a north-up planning mode display.

FIG. 5 is an example of how the MSA indicator 400, including with own-ship indicator 402 appears on a north-up planning mode display 500 that is associated with a digital charting system. In embodiments, when a pilot pans out of range to brief future procedures in the "planning mode", the MSA indicator can be incorporated to not include an own-ship indicator in an information window. In another embodiment, the MSA indicator, including own-ship indicator 402 can be applied to the "execution mode" in a heading up map orientation. In the heading up orientation, the elements of the MSA indicator 400 rotate to keep aligned with the aircraft heading.

The above described embodiments provide the ability to take into account the current aircraft heading and location to create a more meaningful, data driven MSA depiction. Based on the context described herein, the systems that are programmed to provide the information components that are utilized to generate the MSA indicator 400 and own-ship depiction 402 are then able to give targeted information as to where the lowest/highest elevations are in the pilots' surroundings while taking a current context of the aircraft into account.

A data driven system can provide better situation awareness by taking current aircraft context into account. For example, a system (e.g., navigation system 212 will read current location data (e.g. GPS data) and heading data to develop a real-time contextual model. It can then compare this context to a static database (i.e. terrain, obstacles, etc) to create the MSA indicator 400 described herein.

While embodiments are described as using circles, annuli, and ogives to define geographic areas, the use of other shapes is also contemplated. For example, squares, rectangles, triangles, ellipses, ovals, and any other suitable geometric, curvilinear, and/or organic shape may be used with the methods and apparatus described herein. Furthermore, such shapes may be defined as contiguous, separate, and/or intersecting, and any quantity of geographic areas suitable for use with the methods described herein may be defined.

The subject matter of the present disclosure is described with specificity herein to meet statutory requirements. However, the description itself is not intended to limit the scope of this patent. Rather, it has been contemplated that the claimed subject matter might also be embodied in other ways, to include different steps or combinations of steps similar to the ones described in this document, in conjunction with other present or future technologies. Moreover, although the terms "step," "block," and/or "operation" may be used herein to connote different elements of methods employed, the terms should not be interpreted as implying any particular order among or between various steps herein disclosed unless and except when the order of individual steps is explicitly described.

The methods described herein may be encoded as executable instructions embodied in a computer readable medium, including, without limitation, a storage device and/or a memory area of a computing device. Such instructions, when executed by a processor, cause the processor to perform at least a portion of the methods described herein.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for providing a minimum safe altitude indication on an aircraft display, said method comprising:

utilizing current aircraft heading and position data for an aircraft to generate a location and orientation for an own-ship depiction with respect to an aircraft display;

utilizing the current position data, along with terrain data, to generate minimum safe altitude data for an area substantially encompassing the aircraft;

dividing the area substantially encompassing the aircraft into a plurality of zones based on the terrain data; and displaying on the aircraft display, about the location for own-ship depiction, the minimum safe altitude data for the area substantially encompassing the aircraft including the plurality of zones, wherein a plurality of borders associated with the plurality of zones encompass the own-ship depiction, wherein each border of the plurality of borders is indicative of an altitude associated with a respective zone of the plurality of zones, wherein a shading of each zone of the plurality of zones is indicative of the altitude associated with each zone of the plurality of zones, wherein each of the plurality of zones intersects the own-ship depiction, and wherein the plurality of zones are redisplayed to reflect changes as the aircraft travels.

2. The method according to claim 1 wherein each border has a thickness indicative of the altitude associated with a respective zone, wherein a border increases in thickness as the altitude associated with the respective zone increases.

3. The method according to claim 1 wherein each shading has a depth indicative of the altitude associated with a respective zone.

4. The method according to claim 1 wherein displaying minimum safe altitude data comprises displaying a numerical indication of the minimum safe altitude for each of the plurality of zones; each numerical indication having a font size indicative of the altitude associated with a respective zone.

5. The method according to claim 1 wherein displaying the minimum safe altitude data comprises rotating the minimum safe altitude indications on the display to coincide with a change of heading of the aircraft.

6. The method according to claim 1 further comprising displaying the own-ship depiction in one of a north up configuration and a heading up configuration.

7. The method accordingly to claim 1, wherein the plurality of zones form a circular display, and wherein the own-ship depiction is located at a center of the circular display.

8. A minimum safe altitude display system comprising:

a processing device;

a display communicatively coupled to said processing device; and an interface communicatively coupled to said processing device, said interface operable for providing current aircraft heading data for an aircraft, current aircraft position data for the aircraft, and terrain data to said processing device, said processing device programmed to utilize the heading data and the position data to generate a location and orientation for an own-ship depiction with respect to said display, said processing device programmed to utilize the position data and terrain data, to generate minimum safe altitude data for an area substantially encompassing the aircraft, divide the area into a plurality of zones based on the terrain data, and cause the minimum safe altitude data for the area substantially encompassing the aircraft to be displayed on said display about the location for own-ship depiction, the minimum safe altitude data including the plurality of zones, wherein a plurality of borders associated with the plurality of zones encompass the own-ship depiction, wherein at least one border of the plurality of borders is indicative of an altitude associated with at least one zone of the plurality of zones, wherein a shading of the at least one zone is indicative of the altitude associated with the at least one zone, wherein each of the plurality of zones intersects the own-ship depiction, and wherein the minimum safe altitude data is redisplayed to reflect changes as the aircraft travels.

9. The minimum safe altitude display system according to claim 8 wherein each border has a thickness indicative of the altitude associated with a respective zone.

10. The minimum safe altitude display system according to claim 8 wherein each shading has a depth indicative of the altitude associated with a respective zone.

11. The minimum safe altitude display system according to claim 8 wherein said processing device is programmed to cause said display to display a numerical indication of the minimum safe altitude for each of the plurality of zones; each numerical indication having a font size indicative of the altitude associated with a respective zone.

12. The minimum safe altitude display system according to claim 8 wherein said processing device is programmed to cause the minimum safe altitude indication to rotate on said display to coincide with a change of heading of the aircraft.

13. The minimum safe altitude display system according to claim 8 wherein said processing device is programmed to cause said display to display the own-ship depiction in one of a north up configuration and a heading up configuration.

14. The minimum safe altitude display system according to claim 8 wherein said system comprises a moving map display system.

15. A method of displaying minimum safe altitude information, said method comprising:

displaying an own-ship depiction for an aircraft; and displaying a minimum safe altitude depiction for an area that substantially encompasses the own-ship depiction, where the minimum safe altitude depiction maintains an orientation with the own-ship depiction and includes a plurality of zones of the area that substantially encompasses the own-ship depiction, the plurality of zones determined based on terrain data, wherein a plurality of borders associated with the plurality of zones encompass the own-ship depiction, wherein at least one border of the plurality of borders is indicative of an altitude associated with at least one zone of the plurality of zones, wherein a shading of the at least one zone is indicative of the altitude associated with the at least one zone, wherein each of the plurality of zones intersects the own-ship depiction, and wherein the minimum safe altitude depiction is redisplayed to reflect changes as the aircraft travels.

16. The method according to claim 15 wherein displaying a minimum safe altitude depiction comprises:

displaying a numerical indication of the minimum safe altitude proximate each of a plurality of zones within the minimum safe altitude depiction, each zone representing a specific minimum safe altitude, each numerical indication having a font size indicative of the altitude associated with a respective zone.

17. The method according to claim 15 wherein displaying an own-ship depiction comprises displaying the own-ship depiction in one of a north up configuration and a heading up configuration.

18. The method according to claim 15, wherein each zone of the plurality of zones is encompassed by a respective border of the plurality of borders, wherein each of the plurality of borders has a thickness indicative of the altitude associated with a respective zone, and wherein a border increases in thickness as the altitude associated with the respective zone increases.

* * * * *